US008468639B2

(12) United States Patent
Zwijack

(10) Patent No.: US 8,468,639 B2
(45) Date of Patent: Jun. 25, 2013

(54) TOOL FOR EXTRACTING MATERIAL FROM A CONTAINER

(75) Inventor: Tim Zwijack, Camdenton, MO (US)

(73) Assignee: Partnership of Tim Zwijack and Al Rotiroti, Lemont, IL (US)

( * ) Notice: Subject to any disclaimer, the term of this patent is extended or adjusted under 35 U.S.C. 154(b) by 0 days.

(21) Appl. No.: 13/192,131

(22) Filed: Jul. 27, 2011

(65) Prior Publication Data

US 2013/0025082 A1 Jan. 31, 2013

(51) Int. Cl.
*A47L 13/02* (2006.01)
*B05C 17/10* (2006.01)

(52) U.S. Cl.
USPC ..... 15/236.09; 15/236.01; 15/245.1; 30/169

(58) Field of Classification Search
USPC .... 15/236.01, 236.09, 245.1; D8/45; D32/49; 30/169
See application file for complete search history.

(56) References Cited

U.S. PATENT DOCUMENTS

| | | | | | |
|---|---|---|---|---|---|
| D56,574 | S | * | 11/1920 | Waters | D8/45 |
| D57,845 | S | * | 5/1921 | Lickert | D7/688 |
| 1,473,143 | A | * | 11/1923 | Dean | 15/236.01 |
| 2,706,831 | A | * | 4/1955 | Strefling | 15/245.1 |
| 2,900,656 | A | * | 8/1959 | Tupper | 15/245 |
| D254,588 | S | * | 4/1980 | Hogue | D7/688 |
| D260,959 | S | * | 9/1981 | Schnarr | D32/49 |
| D265,601 | S | * | 7/1982 | Olsson | D32/49 |
| 4,817,229 | A | | 4/1989 | Sedillo | |
| D307,862 | S | * | 5/1990 | Masotta | D8/45 |
| 5,699,580 | A | | 12/1997 | Silverstein | |
| 5,920,946 | A | * | 7/1999 | McCarten | 15/236.01 |
| D418,723 | S | * | 1/2000 | Bowman | D7/688 |
| 6,145,151 | A | | 11/2000 | Herron et al. | |
| 6,519,801 | B1 | | 2/2003 | Chao | |
| 6,742,213 | B1 | | 6/2004 | Vaes | |
| 7,458,127 | B2 | * | 12/2008 | Bruno et al. | 15/235.4 |
| 7,464,432 | B2 | | 12/2008 | Goller | |
| 2004/0231087 | A1 | * | 11/2004 | Siegel et al. | 15/236.09 |
| 2009/0229065 | A1 | | 9/2009 | Hansen | |
| 2010/0229319 | A1 | * | 9/2010 | Phillips | 15/236.09 |

* cited by examiner

*Primary Examiner* — Randall Chin
(74) *Attorney, Agent, or Firm* — McAndrews, Held & Malloy, Ltd

(57) ABSTRACT

According to an embodiment of the present invention, an apparatus for extracting material from a container includes a handle and a knife blade. The handle has a neck and a primary axis. The knife blade is coupled to the handle and has a first edge and a second edge. The first edge is configured to conform to a bottom surface of the container. The second edge is configured to conform to an interior wall of the container. An oblique angle is formed by the first edge and the second edge. Another oblique angle is formed between the primary axis of the handle and the first edge of the knife.

10 Claims, 3 Drawing Sheets

TOOL FOR EXTRACTING MATERIAL FROM A CONTAINER

RELATED APPLICATIONS

[Not Applicable]

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

The present application relates to a tool for extracting material from a container.

There are numerous containers (e.g., buckets) that hold various types of material. For example, in the construction industry, containers are used to hold various construction materials. As another example, in the food service industry, containers are used to hold different types of food.

Taking the example of the construction industry, containers are used to hold joint compound which is used to install drywall sheets. Typically, a drywall knife is used to extract material from the container and to apply it to a wall. The container may have a bottom and a sidewall. The sidewall may not be at a right angle to the bottom. Instead, it is common for a container to have a sidewall that is at an oblique angle with respect to the bottom of the container. In such a container, the sidewalls slope away from the bottom, such that the opening of the container is larger than the bottom of the container.

Joint compound may be relatively thick or gummy. Therefore the material may tend to stick to the sidewall of the container. Drywall knives, however, tend to be designed for applying joint compound to a wall and not necessarily for efficiently removing the material from the container.

Consequently, a tool for extracting material from a container is needed to solve these and other problems.

BRIEF SUMMARY OF THE INVENTION

According to an embodiment of the present invention, an apparatus for extracting material from a container includes a handle and a knife blade. The handle has a neck and a primary axis. The primary axis of the handle and the knife blade may be on the same plane. The knife blade is coupled to the handle and has a first edge and a second edge. The first edge is configured to conform to a bottom surface of the container. The second edge is configured to conform to an interior wall of the container. An oblique angle is formed between the primary axis of the handle and the first edge of the knife. This angle could be between approximately 70 degrees and 80 degrees.

The knife blade may also have a third edge between the top of the second edge and the neck of the handle. The third edge may be substantially straight. The blade may also have a fourth edge between the inside of the first edge and the neck of the handle. The fourth edge may have a concave portion proximate to the neck of the handle and a convex portion proximate to the inside of the first edge.

The first edge and the second edge may also form an oblique angle. For example, this angle could be approximately 94 degrees. In an embodiment, the first edge is approximately 5.5 inches long. In an embodiment, the second edge is approximately 4 inches long. In an embodiment, the primary axis of the handle intersects the first edge at a distance of approximately 40% of the length of the first edge away from the outside of the first edge.

According to an embodiment of the present invention, an apparatus for extracting material from a container includes a handle and a knife blade. The handle has a neck and a primary axis. The primary axis of the handle and the knife blade may be on the same plane. The knife blade is coupled to the handle and has a first edge and a second edge. The first edge is configured to conform to a bottom surface of the container. The second edge is configured to conform to an interior wall of the container. The first edge and the second edge form an oblique angle. For example, this angle could be approximately 94 degrees.

The knife blade may also have a third edge between the top of the second edge and the neck of the handle. The third edge may be substantially straight. The blade may also have a fourth edge between the inside of the first edge and the neck of the handle. The fourth edge may have a concave portion proximate to the neck of the handle and a convex portion proximate to the inside of the first edge.

Figure 1A:
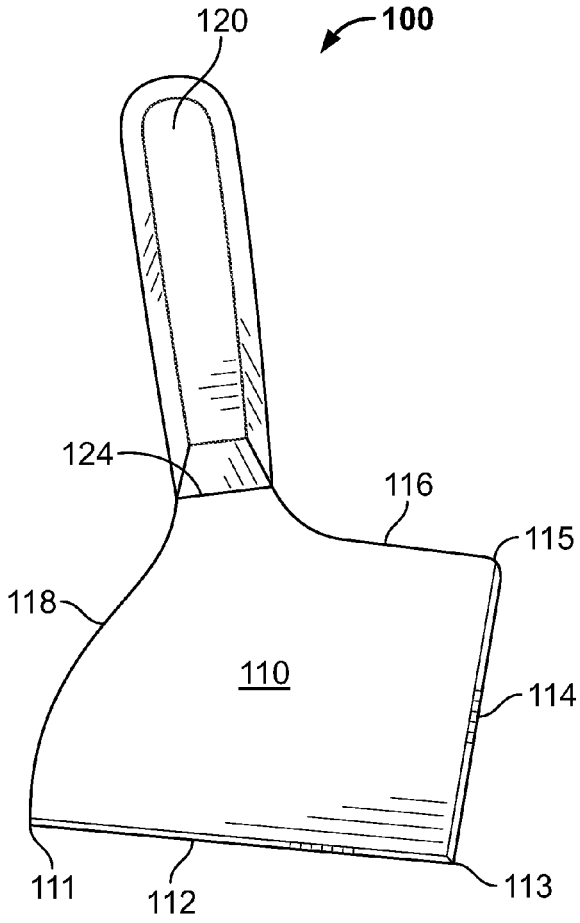
FIGS. 1A and 1B show a tool for extracting material from a container, according to an embodiment of the present invention.

The foregoing summary, as well as the following detailed description of certain embodiments of the present invention, will be better understood when read in conjunction with the appended drawings. For the purposes of illustration, certain embodiments are shown in the drawings. It should be understood, however, that the claims are not limited to the arrangements and instrumentality shown in the attached drawings. Furthermore, the appearance shown in the drawings is one of many ornamental appearances that can be employed to achieve the stated functions of the system.

DETAILED DESCRIPTION OF THE INVENTION

Figure 1B:
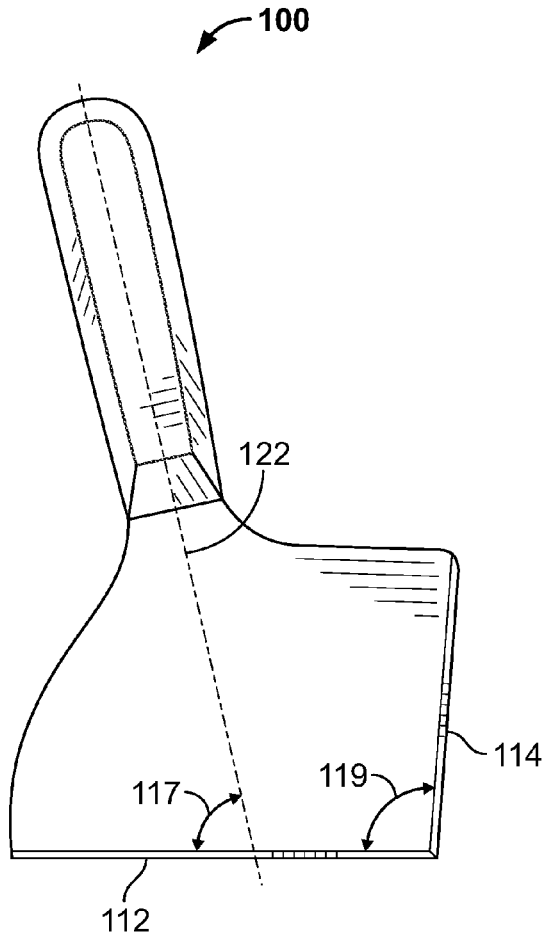

FIGS. 1A and 1B illustrate a tool 100 for extracting material from a container, according to an embodiment of the present invention. The tool 100 includes a knife blade 110 coupled to a handle 120. The knife blade 110 and the handle 120 may be separate components or materials (e.g., wood and steel), or they may be one piece made from the same material. The knife blade may have a first edge 112, a second edge 114, a third edge 116, and a fourth edge 118. The knife blade 110 and the handle 120 may be on the same plane.

The handle 120 has a neck 124 on the end proximate to the knife blade 110. The handle also has a primary axis 122 which indicates an orientation of the handle with respect to the knife blade 110. If the primary axis 122 of the handle 120 is extended, it will cross the first edge 112 of the knife blade 110. The angle 117 between the primary axis 122 of the handle 120 and the first edge 112 may be oblique. For example, the angle 117 may be approximately 70°-80°. The primary axis 112 of the handle 120 and the second edge 114 form an acute angle. Furthermore, the primary axis 122 of the handle 120 may intersect the first edge 112 at a distance of approximately 40% of the length of the first edge 112 away from the outside of the first edge 113. For example, suppose the length of the first edge 112 is 5.5 inches In this case, then the primary axis 122 of the handle 120 would intersect the first edge 112 at approximately 2.2 inches from the outside of the first edge 113. This is merely an example, and other arrangements are also possible.

Figure 3:
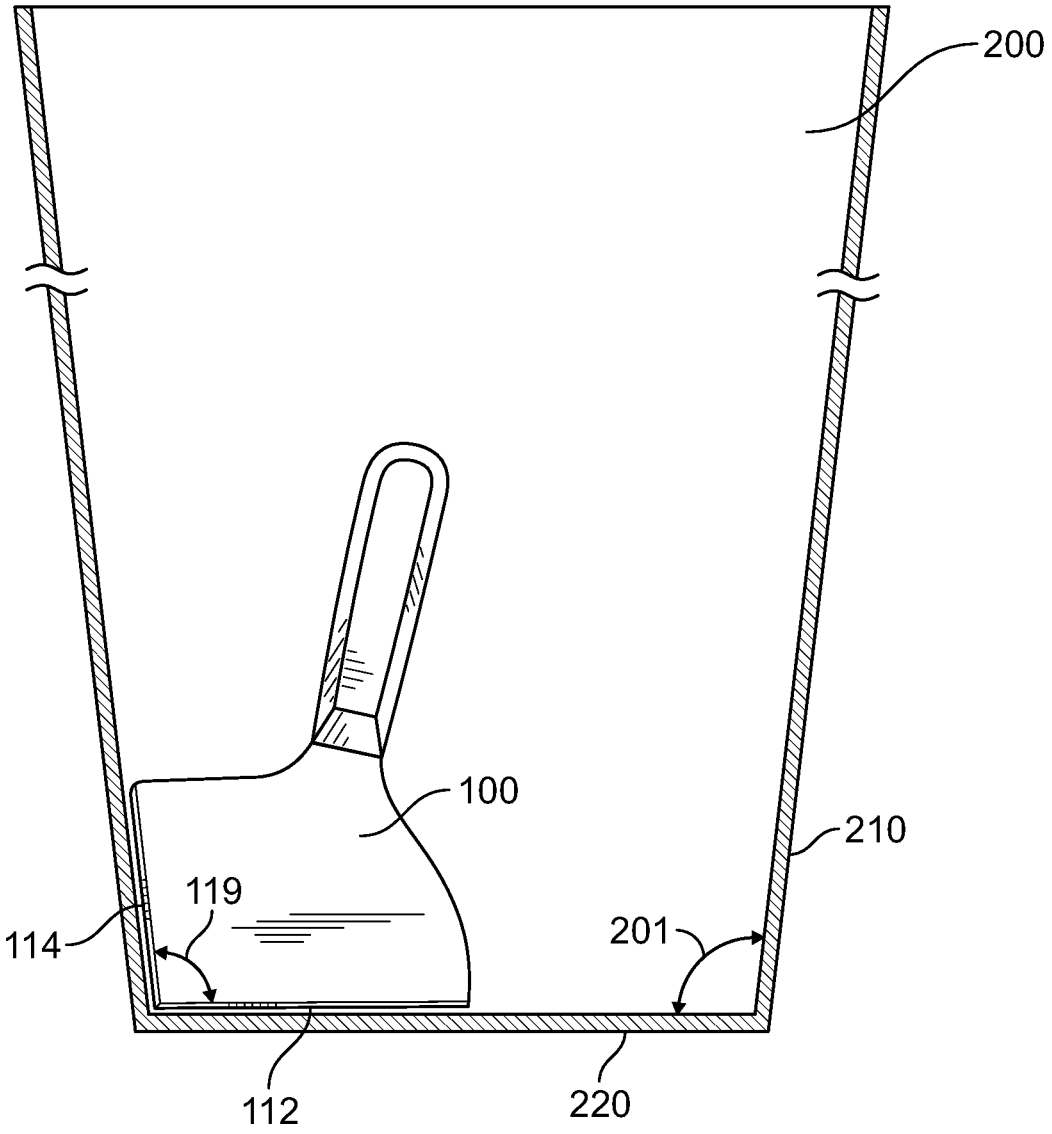
FIG. 3 shows a container and a tool for extracting material from the container, according to an embodiment of the present invention.

The first edge 112 and the second edge 114 form an angle 119, which may be oblique. As shown in FIG. 3, the first edge 112 may be configured to conform to a bottom surface 220 of a container 200. The second edge 114 may be configured to conform to a side surface 210 of the container 200. The angle 119 may approximate the angle 201 between the side surface 210 and the bottom surface 220 of the container 200.

As an example, the angle 119 may be approximately 94°. Such an angle may be useful, for example, if the tool is to be used with a joint compound container that has an angle of approximately 94° between the bottom surface and the side surface. As another example, the angle 119 may match angles found in other types of containers, such as a food service container.

The third edge 116 may extend from the top 115 of the second edge 114 and the neck 124 of the handle 120. The third edge 116 may be substantially straight. The fourth edge 118 may extend from the neck 124 of the handle 120 to the inside 111 of the first edge 112. The fourth edge 118 may be curved. For example, the fourth edge 118 may include a concave portion proximate to the neck 124 and a convex portion proximate to the inside of the first edge 111.

Figure 2:
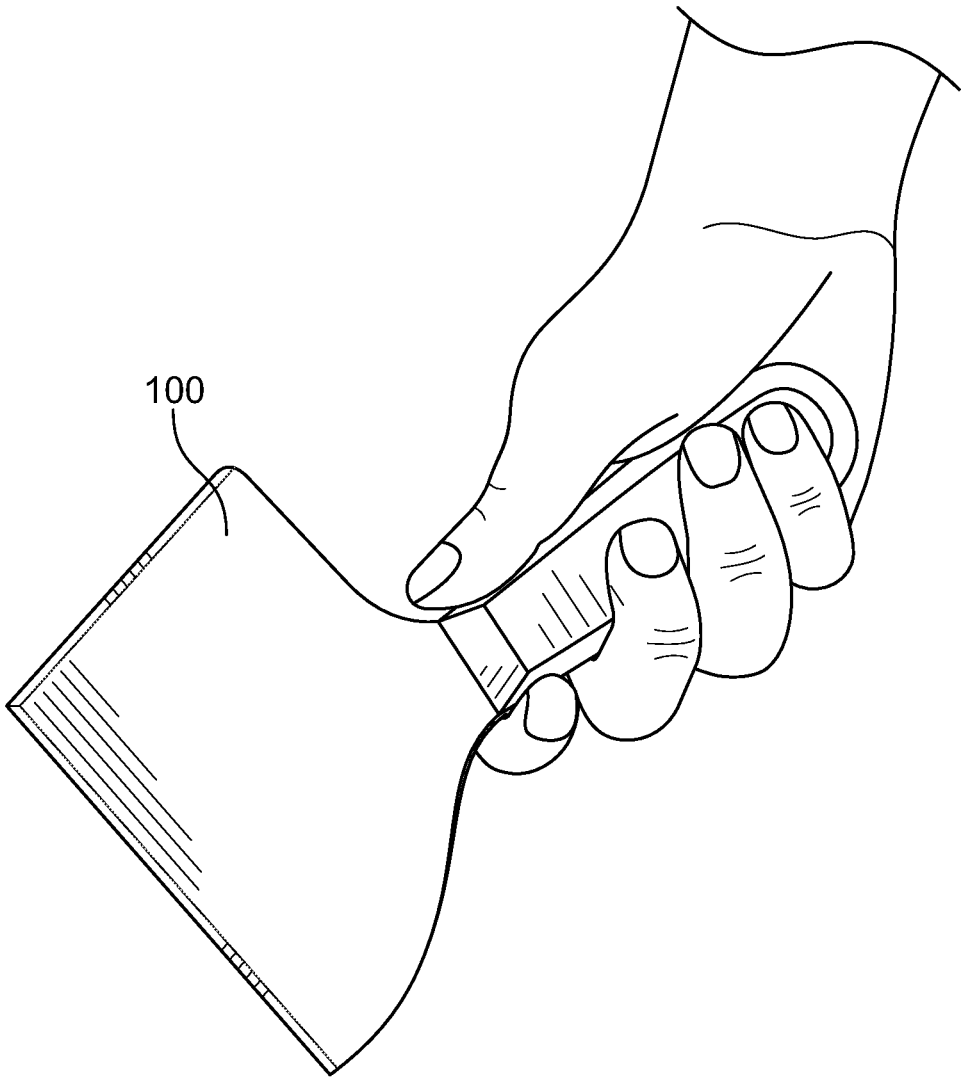
FIG. 2 shows a user's hand holding a tool for extracting material from a container, according to an embodiment of the present invention.

FIG. 2 shows a user's hand holding a tool 100 for extracting material from a container, according to an embodiment of the present invention. As shown, the concave portion of the fourth edge 118 accommodates a user's hand so that his or her index finger (or another finger) tends not interfere with the blade.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

The invention claimed is:

1. An apparatus for extracting material from a container, the apparatus comprising:

a handle including a neck and a primary axis; and a knife blade coupled with the handle, wherein the knife blade includes:

a first edge configured to conform to a bottom surface of the container, a second edge configured to conform to an interior wall of the container, wherein the second edge forms an obtuse angle with the first edge, a third edge between the top of the second edge and the neck of the handle, wherein the third edge includes a concave portion proximate to the neck, and a fourth edge between the inside of the first edge and the neck of the handle, wherein the fourth edge comprises a concave portion proximate to the neck;

wherein:

the primary axis of the handle and the second edge form an acute angle, and the first edge is linear.

2. The apparatus of claim 1, wherein the obtuse angle formed by the first edge and the second edge is approximately 94 degrees.

3. The apparatus of claim 1, wherein the acute angle formed by the primary axis of the handle and the first edge is between approximately 70 degrees and 80 degrees.

4. The apparatus of claim 1, wherein the first edge is approximately 5.5 inches long.

5. The apparatus of claim 1, wherein the second edge is approximately 4 inches long.

6. The apparatus of claim 1, wherein the primary axis of the handle intersects the first edge at a distance of approximately 40% of the length of the first edge away from the outside of the first edge.

7. The apparatus of claim 1, wherein the third edge is substantially straight.

8. The apparatus of claim 1, wherein the fourth edge comprises a convex portion proximate to the inside of the first edge.

9. The apparatus of claim 1, wherein the primary axis of the handle and the knife blade are on the same plane.

10. The apparatus of claim 1, wherein the second edge is linear.

* * * * *